US007770413B2

(12) United States Patent
Tyler

(10) Patent No.: US 7,770,413 B2
(45) Date of Patent: Aug. 10, 2010

(54) BODY JEWELRY

(76) Inventor: Melissa Tyler, 100 Marginal St., East Boston, MA (US) 02128

( * ) Notice: Subject to any disclaimer, the term of this patent is extended or adjusted under 35 U.S.C. 154(b) by 84 days.

(21) Appl. No.: 12/041,697

(22) Filed: Mar. 4, 2008

(65) Prior Publication Data

US 2009/0049865 A1 Feb. 26, 2009

Related U.S. Application Data

(62) Division of application No. 11/160,989, filed on Jul. 19, 2005, now Pat. No. 7,343,760.

(60) Provisional application No. 60/592,974, filed on Jul. 30, 2004.

(51) Int. Cl.
*A44C 7/00* (2006.01)
*A44C 15/00* (2006.01)

(52) U.S. Cl. ..... 63/12; 63/900; 24/303; 24/705

(58) Field of Classification Search ..... None
See application file for complete search history.

(56) References Cited

U.S. PATENT DOCUMENTS

| | | | | |
|---|---|---|---|---|
| 237,985 | A * | 2/1881 | Lavell | 24/110 |
| 260,692 | A | 7/1882 | Krementz | |
| 267,112 | A | 11/1882 | Sanderson | |
| 731,162 | A | 6/1903 | Carter | |
| 1,003,696 | A | 9/1911 | Briggs | |
| 2,874,435 | A | 2/1959 | Nielsen | |
| 3,504,507 | A * | 4/1970 | Ferro | 63/12 |
| 4,694,664 | A | 9/1987 | Elsener et al. | |
| 4,815,180 | A | 3/1989 | Elsener | |
| 5,816,073 | A | 10/1998 | Bardisbanyan | |
| 6,026,659 | A * | 2/2000 | Kaping, Jr. | 63/12 |
| 6,125,657 | A | 10/2000 | Esposito | |
| 6,470,709 | B1 * | 10/2002 | Siekierski | 63/12 |
| 6,557,220 | B1 | 5/2003 | Hamm, Jr. | |
| 6,568,214 | B2 | 5/2003 | Wolff et al. | |
| 6,581,244 | B1 | 6/2003 | Peters et al. | |
| 6,584,656 | B1 * | 7/2003 | Karmeli | 24/705 |
| 6,622,522 | B2 | 9/2003 | Abramson et al. | |

* cited by examiner

*Primary Examiner*—Jack W. Lavinder
(74) *Attorney, Agent, or Firm*—Nutter McClennen & Fish LLP

(57) ABSTRACT

Various jewelry devices are provided for use in a pierced body part, such as the naval, and/or with devices implanted in a pierced body part. In one embodiment, a ring-shaped member is provided and it includes a first semi-circular member having first and second terminal ends, and a second semi-circular member having a first portion that is hingedly connected to the first terminal end of the first semi-circular member and a second portion that is fixedly mated to the first portion and that includes a terminal end that is adapted to removably mate to the second terminal end of the first component. The present invention also provides a connector for easily removably mating various jewelry ornaments to a jewelry device that is worn in a pierced body part.

11 Claims, 7 Drawing Sheets

BODY JEWELRY

CROSS-REFERENCE TO RELATED APPLICATIONS

This application is a divisional of U.S. patent application Ser. No. 11/160,989 filed on Jul. 19, 2005 and entitled "Body Jewelry," which claims priority to U.S. Provisional Application Ser. No. 60/592,974 filed on Jul. 30, 2004 and entitled "Body Jewelry." These references are hereby incorporated by reference in their entireties.

FIELD OF THE INVENTION

The present invention relates to body jewelry, and more preferably to body jewelry to be worn in and/or hung from a pierced navel or other pierced body part.

BACKGROUND OF THE INVENTION

Body piercing has become increasingly popular in the United States and abroad, and thus several jewelry designs have been developed for use at particular locations on the body. One common type of design is the captive bead ring which is particularly adapted for use in naval piercings. The design includes a bead having holes or dimples on opposite sides thereof that are adapted to seat opposed ends of a ring having an opening or break formed therein. The beads can have a variety of shapes and sizes, and they often include ornamental features, such as jewels, stones, and other accessories incorporated therein.

In use, the ring is placed through the pierced orifice in the navel, and the bead is then positioned between the ends of the ring. While many factors affect how tightly the bead is held in place with respect to the ring, most designs require pliers or some other tool for expanding the ring to release the bead. Such a tight fit will prevent the bead from accidentally falling off during use. However, the tight fit can also make it difficult for the user to remove the jewelry themselves, or to change the bead.

Another common design for use with naval piercings, as well as for use in other areas of the body, is the barbell design which includes a straight or curved rod having a ball on each end or a ball and a charm affixed thereto. Normally, one ball or a charm is fixedly attached to the rod and the other ball is adjoined to the rod by a screw to allow removal of the barbell from the pierced orifice. While the barbell design does provide an adequate body piercing jewelry style, they are limited by the amount, shape, and size of ornaments that can be implemented therewith. The removable ball on the barbell design can also be awkward and difficult to remove due to the small size of the ball.

Accordingly, there remains a need for improved body jewelry that is easy to insert and remove from a pierced orifice, and/or and that allows for simple changing of ornamentation.

SUMMARY OF THE INVENTION

The present invention generally provides body jewelry for wearing in a naval orifice or other pierced body part. While the body jewelry can have a variety of configurations, in one embodiment a ring-shaped member is provided and it includes a first substantially semi-circular member having first and second terminal ends, and a second substantially semi-circular member having a first portion that is hingedly connected to the first terminal end of the first semi-circular member and a second portion that is fixedly mated to the first portion and that includes a terminal end that is adapted to removably mate to the second terminal end of the first substantially semi-circular member. The second portion is preferably adapted to extend through a pierced body part, such as a naval orifice, and thus it preferably has a substantially cylindrical cross-section. The body jewelry can also include a coupling mechanism attached to one of the first semi-circular member and the first portion of the second semi-circular member. The coupling mechanism can be, for example, a hoop that is fixedly attached to one of the first semi-circular member and the first portion of the second semi-circular member.

In one aspect of the invention, the first semi-circular member has an arc length that is less than an arc length of the second semi-circular member, and more preferably the second portion of the second semi-circular member has an arc length that is greater than an arc length of the first portion of the second semi-circular member. In another embodiment, at least a portion of the first substantially semi-circular portion can include an inward facing cavity formed therein and extending along at least a portion of a length thereof for receiving the terminal end of the second portion of the second substantially semi-circular portion.

In other aspects, the terminal end of the second portion of the second semi-circular member can include a projection formed thereon and the first semi-circular member can include a bore extending into the second terminal end thereof and including a recess formed therein for receiving the projection such that a snap-fit is provided between the second portion of the second semi-circular member and the first semi-circular member. The second portion of the second semi-circular member can optionally be flexible or it can include a biasing element to allow a force to be applied thereto to release the second portion of the semi-circular member from the first semi-circular member. The projection can be formed from a cut-out portion formed adjacent a terminal end of the second portion of the second semi-circular member.

In yet another embodiment of the present invention, a jewelry connector for coupling an ornament to body piercing jewelry disposed within a naval orifice or other pierced body part is provided. The connector can include a body having a top portion and a hook-shaped portion extending distally therefrom and having a terminal end. A lever is also preferably provided and includes a mid-portion that is coupled to the top portion of the body and that is movable between first and second positions. The top portion of the body can include a cavity formed therethrough for pivotally seating the mid-portion of the lever. The lever can also include an extension member formed on the mid-portion and extending from the mid-portion toward the terminal end of the hook-shaped portion such that, when the mid-portion is in the first position, the terminal end of the extension member is spaced a distance apart from the terminal end of the hook-shaped portion, and when the mid-portion is in the second position, the terminal end of the extension member engages the terminal end of the hook-shaped portion. The lever can also include a face plate formed on the mid-portion opposed to the extension member, and a biasing member adapted to bias the mid-portion to the second position. The face plate can have a variety of shapes and sizes. Suitable shapes include, by way of non-limiting example, a heart, a square, a circle, an oval, a rectangle, a star, a triangle, and a crescent.

The present invention also provides, in yet another embodiment, a barbell-type body jewelry device that is adapted to be worn in a naval orifice or other pierced body part. The ornament can have a variety of configurations, but it preferably has an elongate member having opposed first and second ends, a first body fixedly attached to the first end of the elongate member, and a second body removably coupled to the second end and having a size adapted to prevent passage thereof through a pierced naval orifice or other pierced body part. While various techniques can be used to removably coupled the second body to the second end of the elongate member, in one embodiment the second body can include a cavity formed therein and adapted to removably receive the second end of the elongate member. A clamping mechanism can be formed within the cavity and effective to clamp the second end of the elongate member, and an actuating mechanism can be coupled to the clamping mechanism and effective to release the clamping mechanism upon actuation thereof, thereby releasing the second end of the elongate member from the second body.

In other aspects of the present invention, a body jewelry device for wearing in a naval orifice or other pierced body part is provided having a body having a top portion with a cavity extending therethrough for receiving a portion of a ring disposed through a pierced naval orifice or other pierced body part, and a bottom J-shaped portion that is adapted to receive an ornament. A lever is pivotally coupled to the body and it is movable between an open position, in which the lever is spaced apart from the J-shaped portion of the body, and a closed position, in which the lever is in contact with the J-shaped portion of the body to retain an ornament therein. The device can also include a face plate coupled to the lever and adapted to move the lever between the open and closed positions.

BRIEF DESCRIPTION OF THE DRAWINGS

The invention will be more fully understood from the following detailed description taken in conjunction with the accompanying drawings, in which.

DETAILED DESCRIPTION OF THE INVENTION

The present invention provides various jewelry devices that are configured for use in a naval orifice or other pierced body part, and in particular that are configured for easy insertion and removal from a pierced orifice or other pierced body part. The present invention also provides various jewelry devices that are configured for use in conjunction with jewelry worn in a naval orifice or other pierced body part.

Figure 1A:
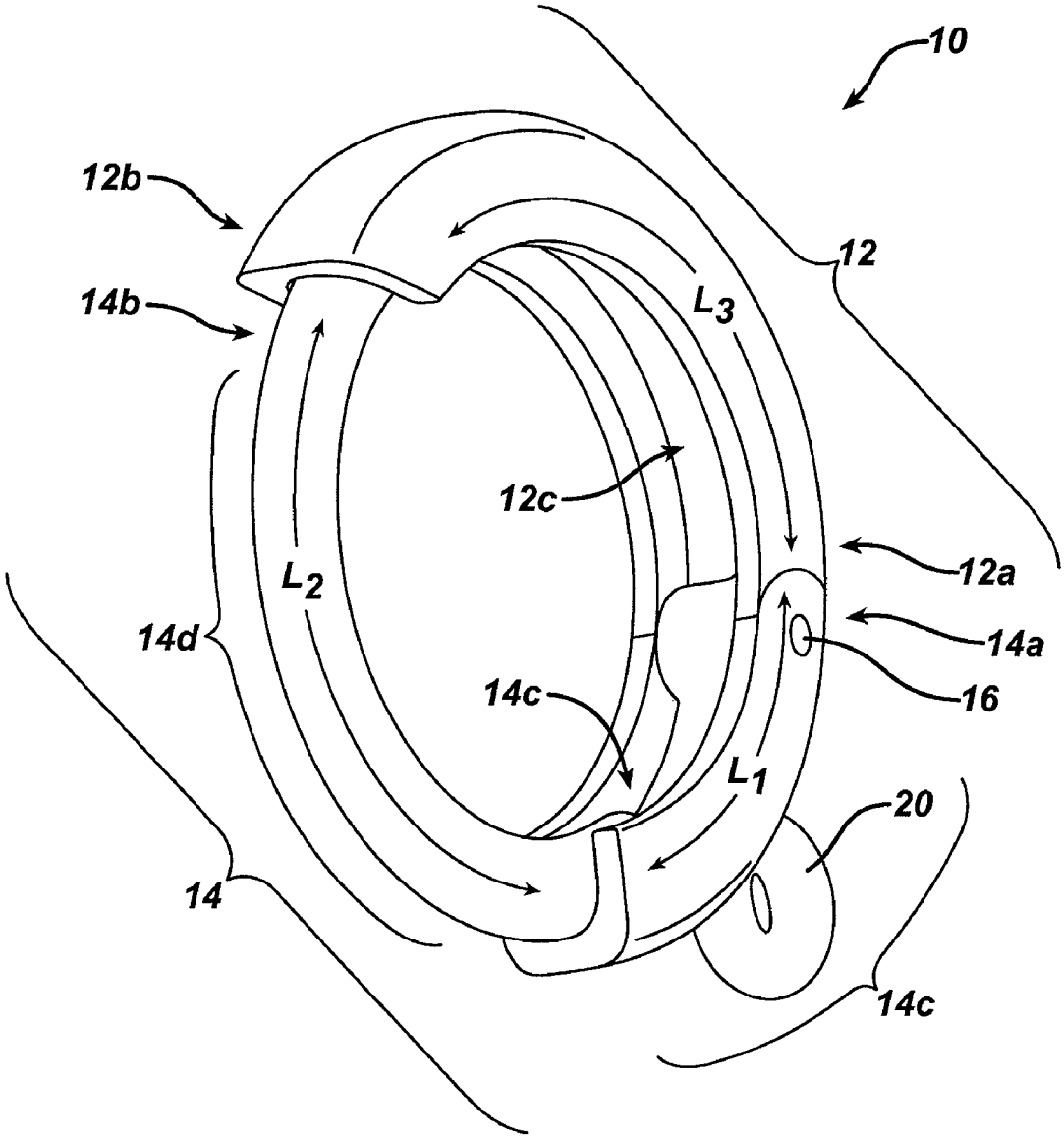
FIG. 1A is side perspective view of one embodiment of a tension ring jewelry device in accordance with the present invention.
Figure 1B:
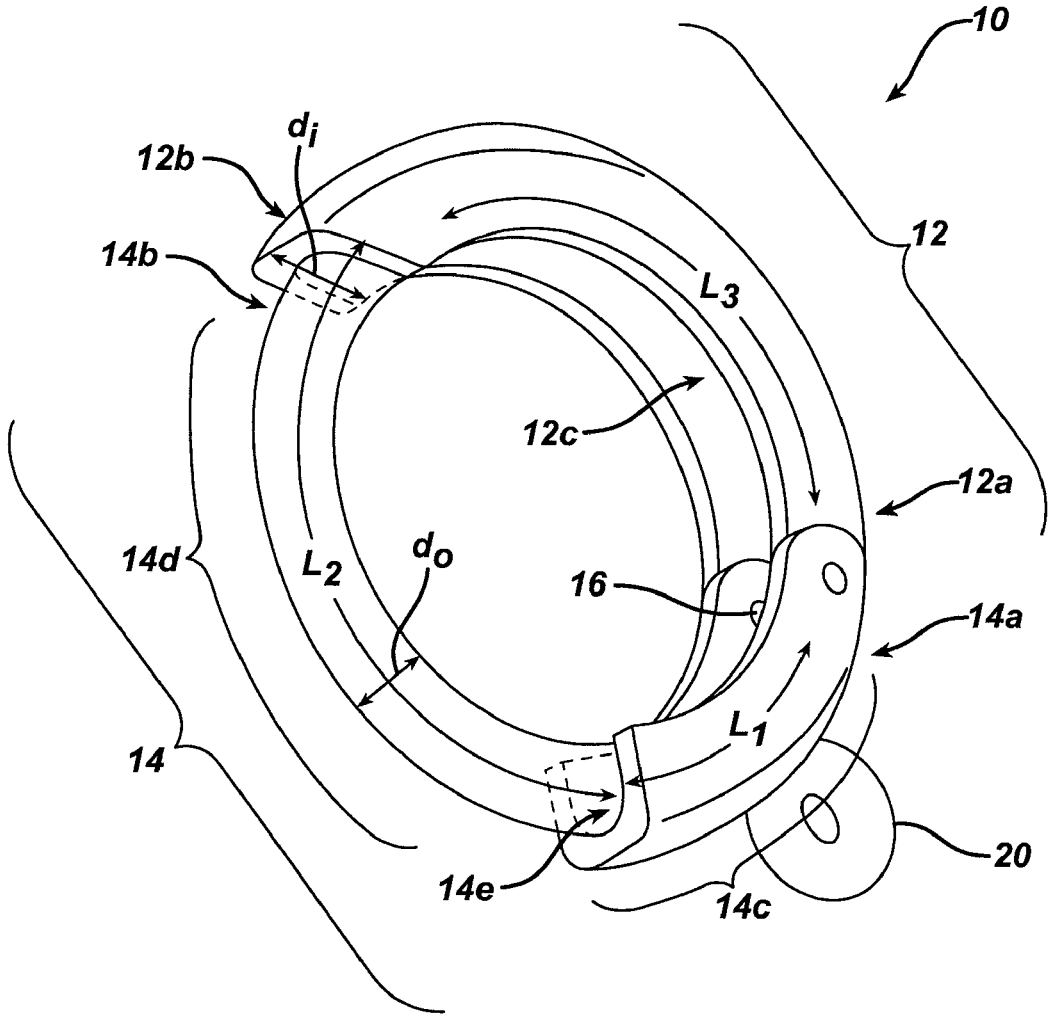
FIG. 1B is a transparent view of the tension ring shown in FIG. 1A.

FIGS. 1A-1B illustrate a jewelry device 10 that is in the form of a hinged tension ring in accordance with one embodiment of the present invention. As shown, the hinged tension ring is generally circular-shaped and it includes first and second substantially semi-circular members 12, 14, each having first and second terminal ends 12*a*, 12*b*, 14*a*, 14*b*. The first terminal end 12*a*, 14*a* of each member 12, 14 can be movably connected to one another, and the second terminal end 12*b*, 14*b* of each member 12, 14 can be removably matable to one another. This allows the first and second semi-circular members 12, 14 to be moved between an open position, in which the members 12, 14 are separated from one another to allow one of the portions, e.g., the second member 14, to be inserted through a pierced orifice, and a closed position, in which the semi-circular members 12, 14 are re-attached or otherwise re-connected to one another to retain the jewelry device 10 within the pierced orifice. The hinged tension ring 10 is particularly advantageous for use in a naval orifice as it allows easy insertion and removal into a pierced orifice, and it can provide a mechanism for allowing various ornamentation to be coupled thereto.

While each semi-circular member 12, 14 of the hinged tension ring 10 can have a variety of configurations, in an exemplary embodiment, as shown, the first member 12 of the hinged tension ring 10 preferably has a substantially hollow cavity 12*c* formed within an inner portion thereof and extending along a length thereof. The cavity 12*c* allows at least a portion of the second member 14 to be positioned therein for mating the first and second members 12, 14, as will be discussed in more detail below. The cavity 12*c* can also be effective to reduce the overall weight of the hinged tension ring 10. The second member 14 can also have a variety of configurations, but in an exemplary embodiment, as shown, the second member 14 includes a first portion 14*c* adjacent the first terminal end 14*a*, and a second portion 14*d* adjacent the second terminal end 14*b*. The first portion 14*c* preferably has a hollow cavity 14*e* formed therein and extending along a length thereof, and the second portion 14*d* preferably has a substantially cylindrical cross-section. The first portion 14*c* can, however, have a solid cavity or it can other shapes and sizes to accommodate other elements, such as jewels, etc. The second portion 14*d* is preferably fixedly attached to the first portion 14*c*, and various techniques can be used to attach the portions 14*c*, 14*d*. In the illustrated embodiment, at least portion of the second portion 14*d* extends into the hollow cavity 14*e* of the first portion 14*c*. The two portions 14*c*, 14*d* can be welded or otherwise mated together to retain the second portion 14*d* within the hollow cavity 14*e* of the first portion 14*c*.

A person skilled in the art will appreciate that the first member 12 and/or the first portion 14*c* of the second member 14 can include a variety of other features, including decorative features such as jewels attached thereto or disposed therein, and the shape of each portion 12, 14*c* can vary depending on the decorative or ornamental features formed thereon.

In use, the second portion 14*d* of the second member 14 is preferably configured to extend through a pierced orifice, while the first portion 14*c* preferably has a size that prevents passage through a pierced orifice. In an exemplary embodiment, the first portion 14*c* has a substantially cylindrical cross-section that has a gauge that is greater than about 1 mm, and more preferably that is about 1.6 mm. The second portion 14*d* also preferably has an arc length $L_2$ that is greater than an arc length $L_1$ of the first portion 14*c* of the second member 14. The first and second portions 14*c*, 14*d*, e.g., the second member 14, can also have a combined arc length that is greater than an arc length $L_3$ of the first member 12. Such a configuration allows the second portion 14*d* of the second member 14 to extend through a pierced orifice without significant rotating of the hinged tension ring 10, as the first member 12 and the first portion 14*c* of the second member 14 each preferably have a cross-sectional diameter that prevents passage thereof through the orifice. Such a configuration is further advantageous as it allows a coupling mechanism to be formed at a specific location on the hinged tension ring 10 for receiving an ornament, thus retaining the ornament in a substantially fixed position, as will be discussed in more detail below.

As previously stated, the first and second members 12, 14 are preferably movable coupled to one another at a first terminal end 12*a*, 14*a* thereof, and they are preferably removably matable to one another at a second terminal end 12*b*, 14*b* thereof. While various techniques can be used for mating the first terminal end 14*b* of the second member 14 to the first terminal end 12*a* of the first member 12, in an exemplary embodiment, as shown, the first terminal end 14*a* of the second member 14 is hingedly connected to the terminal end 12*a* of the first member 12. As shown in FIGS. 1A-1B, a pivot pin 16 can extend through a bore formed through each terminal end 12*a*, 14*a* of the first and second members 12, 14. Thus, in use, the second member 14 can be pivotally rotated with respect to the first member 12. A person skilled in the art will appreciate that a variety of other techniques can be used to mate the terminal ends 12*a*, 14*a* of the members 12, 14 to one another including, for example, a snapping connection, a sliding connection, or any other connection known in the art.

A variety of techniques can also be used to removably mate the second terminal end 12*b*, 14*b* of each member 12, 14 to one another. In an exemplary embodiment, however, a friction fit or snap connection is used to mate the members 12, 14. By way of non-limiting example, the second terminal end 12*b* of the first member can include a ridge or protrusion (not shown) formed within the cavity 12*c* therein for engaging a corresponding detent or groove formed on and/or around the second terminal end 14*b* of the second member 14. In other embodiments, the cavity 12*c*, or at least a portion of the cavity 12*c* adjacent the terminal end 12*b*, can have an inner diameter $d_i$ (FIG. 1B) that is substantially the same as or less than an outer diameter do of the terminal end 14*b* of the second member 14. As a result, when the second member 14 is positioned within the cavity 12*c*, the first member 12 will be effective to engage the second member 14. The first member 12 is preferably formed from a material that allows some flexibility to allow the first member 12 to expand around the second member 14. A person skilled in the art will appreciate that a variety of other techniques can be used to removably mate the first and second members 12, 14 to one another.

As previously indicated, the hinged tension ring 10 also preferably includes a coupling mechanism that is adapted to receive at least one ornament. While various coupling mechanisms can be used, in the illustrated embodiment a hoop 20 is formed on or fixedly attached to the device 10. More preferably, the hoop 20 is attached to the first portion 14*c* of the second member 14, such that, when the device is inserted through a pierced body part, such as a naval orifice, the hoop 20 is positioned on a lower portion of the device to allow charms or ornaments to extend therethrough and essentially dangle from the device 10. In other words, the hoop 20 is preferably co-planar with the hinged tension ring 10.

Figure 2A:
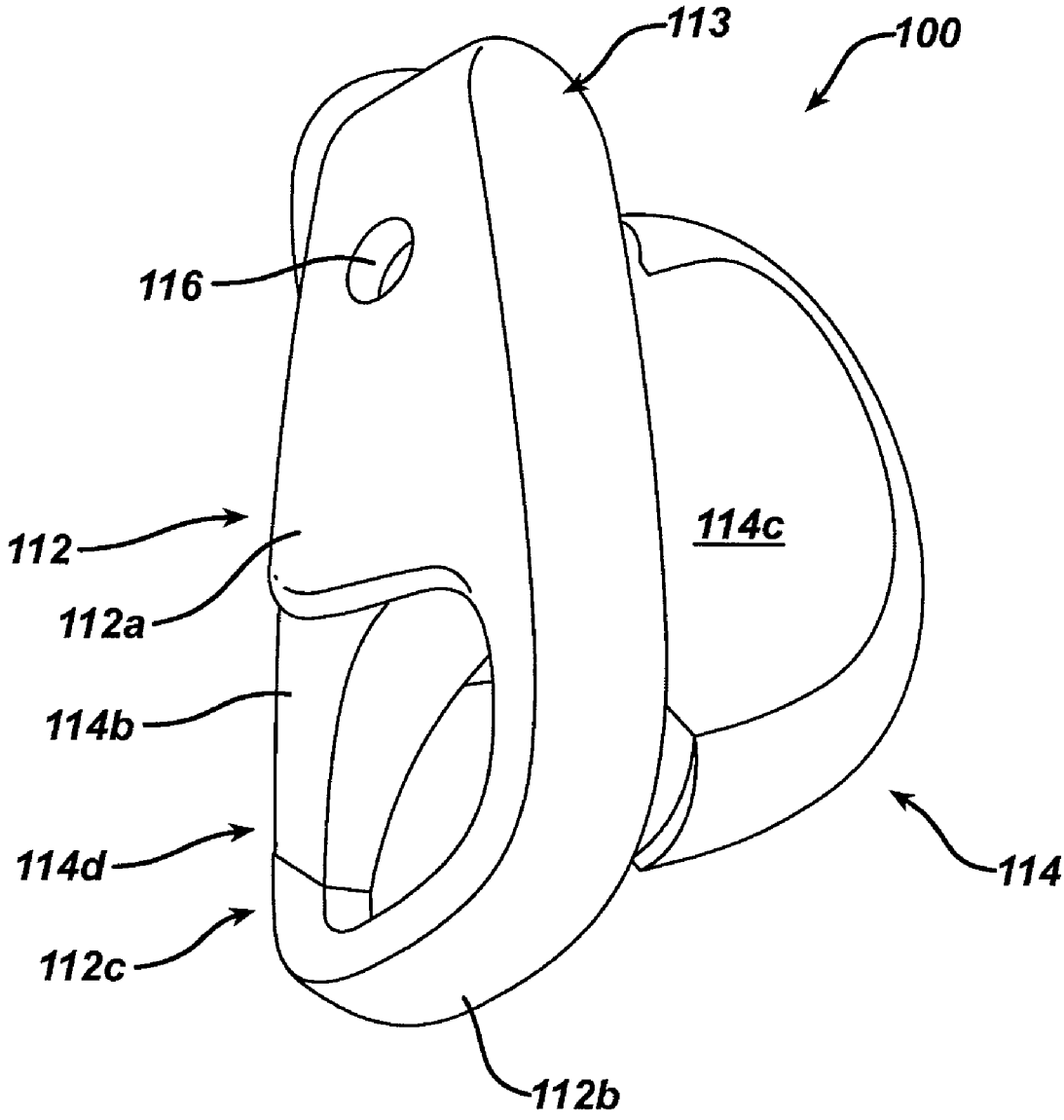
FIG. 2A is a transparent, front view of a jewelry connector that is removably matable to a jewelry device, such as the tension ring, in accordance with another embodiment of the present invention.
Figure 2B:
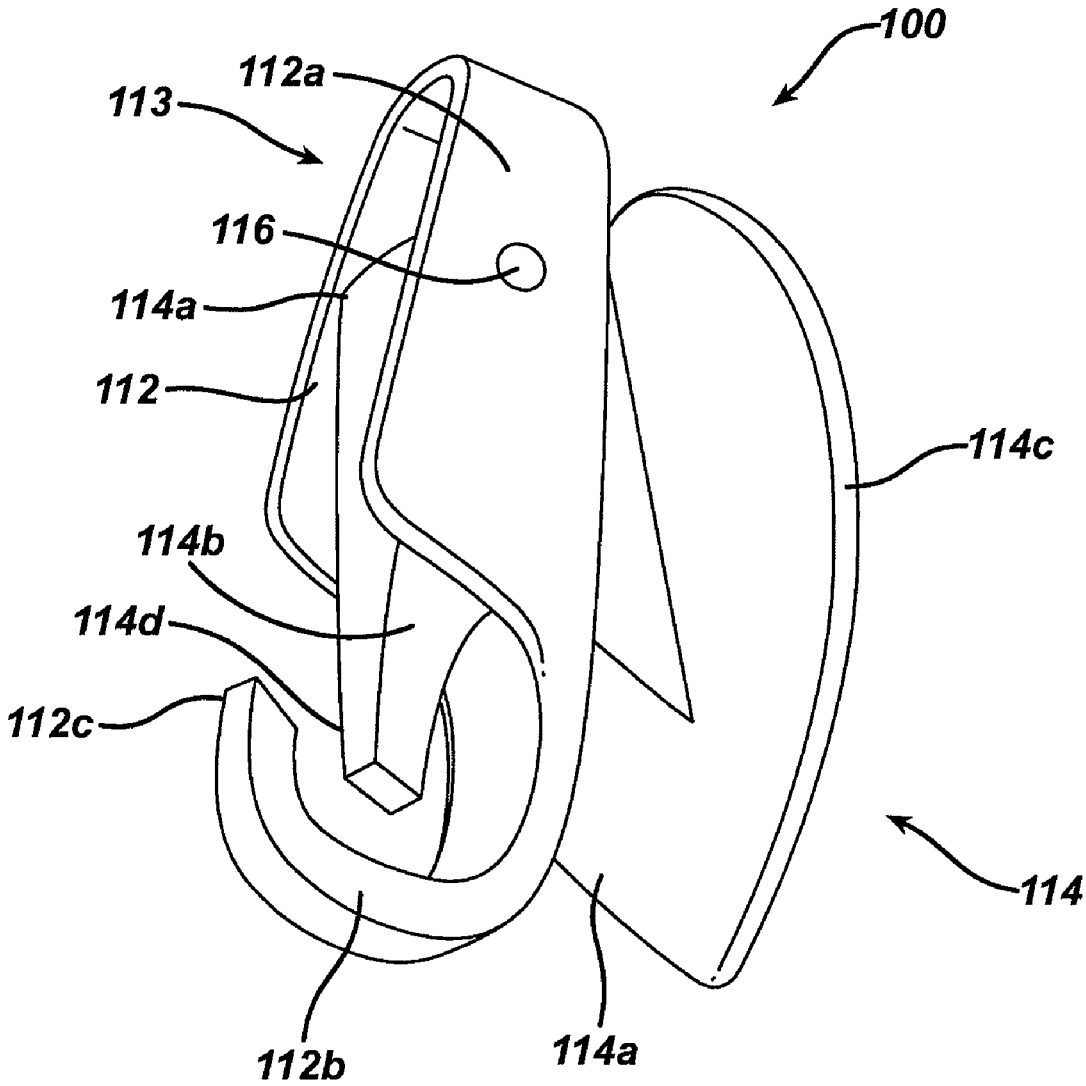
FIG. 2B is a back perspective view of the connector shown in FIG. 2A.
Figure 2C:
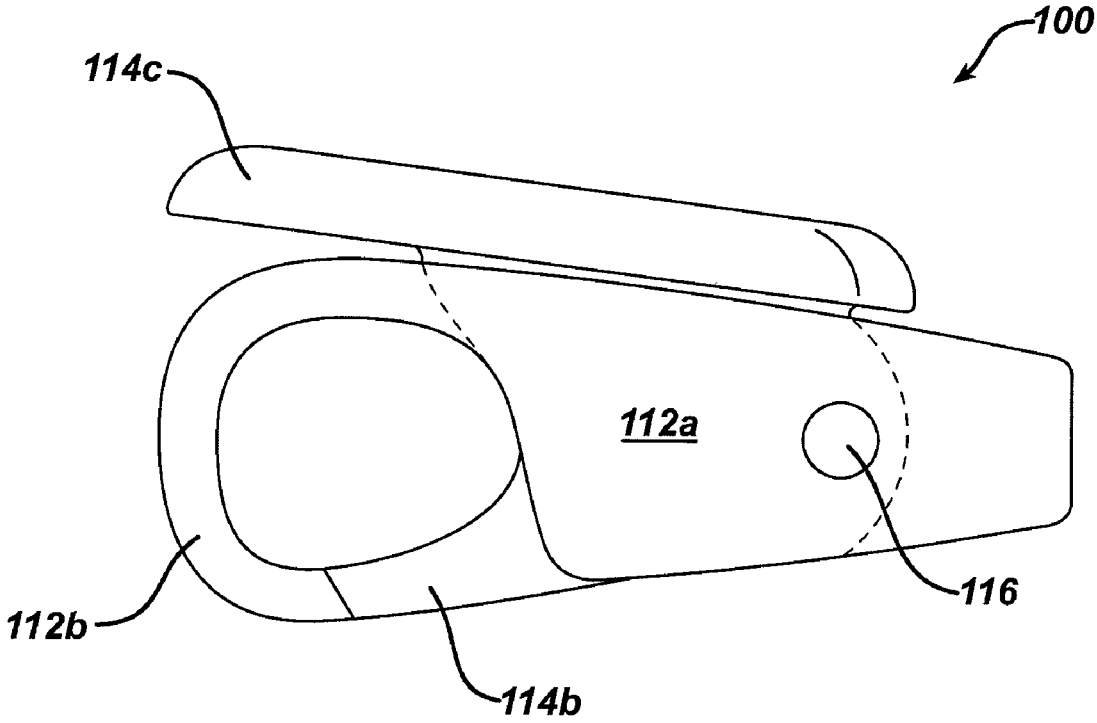
FIG. 2C is a side view of the connector shown in FIG. 2A.

In accordance with another embodiment of the present invention, FIGS. 2A-2C illustrate a jewelry connector 100 that is adapted to fixedly or removably mate to a jewelry device that is inserted through a pierced naval orifice or other pierced body part, and that is adapted to receive an ornament for mating the ornament to the jewelry device. As shown, the connector 100 generally includes a body 112 having a top portion 112*a* with a hook-shaped member 112*b* extending distally therefrom, and a lever 114 having a mid-portion 114*a*, an extension member 114*b*, and optionally a face plate 114*c*. The mid-portion 114*a* of the lever 114 is movably coupled to the top portion 112*a* of the body 112, and the extension member 114*b* extends distally from the mid-portion 114*a* toward a terminal end 112*c* of the hook-shaped portion 112*b*. The face plate 114*c*, which is formed on the mid-portion 114*a* opposed to the extension member 114*b*, allows the lever 114 to be grasped and moved between a first, closed position, shown in FIG. 2A, in which a terminal end 114*d* of the extension member 114*b* is substantially adjacent or in contact with the terminal end 112*c* of the hook-shaped portion 112*a*, and a second, open position, shown in FIG. 2B, in which the terminal end 114*d* of the extension member 114*b* is spaced a distance apart from the terminal end 112*c* of the hook-shaped portion 112*b*. When the lever 114 is engaged and in the open position, one or more ornaments can be attached to the hook-shaped portion 112*b*. The lever 114 can then be released and returned to the closed position to retain the ornament on the device 100. To subsequently remove the device 100, the lever 114 can simply be grasped and moved to the open position. The device 100 can also include a biasing member (not shown) that is adapted to bias the lever 114 to the closed position with respect to the body 112.

The body 112 can have a variety of shapes and sizes, but preferably the top portion 112*a* of the body 112 is adapted to movably receive the mid-portion 114*a* of the lever 114. In the illustrated embodiment, the top portion 112*a* of the body 112 is substantially hollow or includes a cavity formed therein for seating the mid-portion 114*a* of the lever 114. The top portion 112*a* of the body 112 should allow the lever 114 to rotate with respect thereto to allow the lever 114 to be moved between the open and closed positions. In order to movably mate the lever 114 to the body 112, a pivot pin 116 can extend through the top portion 112*a* of the body 112 and through the mid-portion 114*a* of the lever 114. As previously stated, a biasing member, such as a spring, can also be provided for biasing the lever 114 to the closed position with respect to the body 112.

The top portion 112*a* of the body 112 is also preferably adapted to receive a jewelry device that is implanted in a pierced naval orifice or other pierced body part. While the connector 100 can be used with various jewelry devices, in an exemplary embodiment the connector 100 is coupled to a tension ring, preferably one that is implanted when the naval or other body part is first pierced. This allows the wearer to easily add various charms to the connector 100 without having to remove the tension ring from their naval or other body part. Various techniques can be used to mate the connector 100 to a tension ring, but in an exemplary embodiment the connector 100 includes an opening 113 that extends through the top portion 112*a* of the body 112 for slidably receiving the tension ring. The opening 113 allows some movement between the tension ring and the connector 100. A person skilled in the art will appreciate that various other techniques can be used to mate the connector 100 to a jewelry device inserted through a pierced naval orifice or other pierced body part.

The body 112 also includes a hook-shaped portion 112*b* that is configured to receive an ornament. The hook-shaped portion 112*b* preferably extends in a direction away from the face plate 114*c* of the lever 114 to allow an ornament to simply be placed through the terminal end 112*c* of the hook-shaped portion 112*b* without interference from the lever 114.

The lever 114, which is movably coupled to the body 112, can also have a variety of configurations, but in an exemplary embodiment, as shown, the lever 114 includes a mid-portion 114*a* that is configured to sit within the hollow region of the top portion 112*a* of the body 112. The extension member 114*b* extends from the mid-portion 114*a* toward the hook-shaped member 112*b*, and it preferably has a length such that the terminal end 114*d* of the extension member 114*b* contacts the terminal end 112*c* of the hook-shaped member 112*b*. This allows the extension member 114*b* and the hook-shaped member 112*b* to form an enclosed hoop when the lever 114 is in the closed position.

The face plate 114*c* on the lever 114 can also have a variety of configurations, shapes, and sizes, but it is preferably adapted to allow the lever 114 to be grasped and moved between the open and closed positions. In the illustrated embodiment, the face plate 114*c* is in the shape of a heart and it is formed on or fixedly attached to the mid-portion 114*a* of the lever 114. In use, when an ornament is attached to the hook-shaped member 112*b* of the body 112, the face plate 114*c* essentially hides the body 112 and the remainder of the lever 114, serving as a decorative feature. The face plate 114*c* also functions as a grasping element to allow a person to place one finger on the hook-shaped portion 112*b* of the body, while pulling the face plate 114*c* away from the body 112, thereby moving the lever 114 into an open position. Release of the face plate 114*c* will allow the lever 114 to return to the closed position. A person skilled in the art will appreciate that the face plate 114*c* can have a variety of shapes and sizes. By way of non-limiting example, suitable shapes include, a heart, a square, a circle, an oval, a rectangle, a star, a triangle, and a crescent, and any other shape including irregular shapes.

In use, as previously indicated, the top portion 112*a* of the body 112 can be slidably coupled to a jewelry device that is inserted through a pierced naval orifice or other pierced body part. In particular, a tension ring (not shown) is preferably passed through the opening 113 in the top portion 112*a* of the body 112 prior to closing the tension ring to affix it within the pierced naval orifice or other pierced body part. The lever 114 can then be used to open and close the hook-shaped portion 112*b* to allow an ornament to be coupled to the connector 100.

Figure 3:
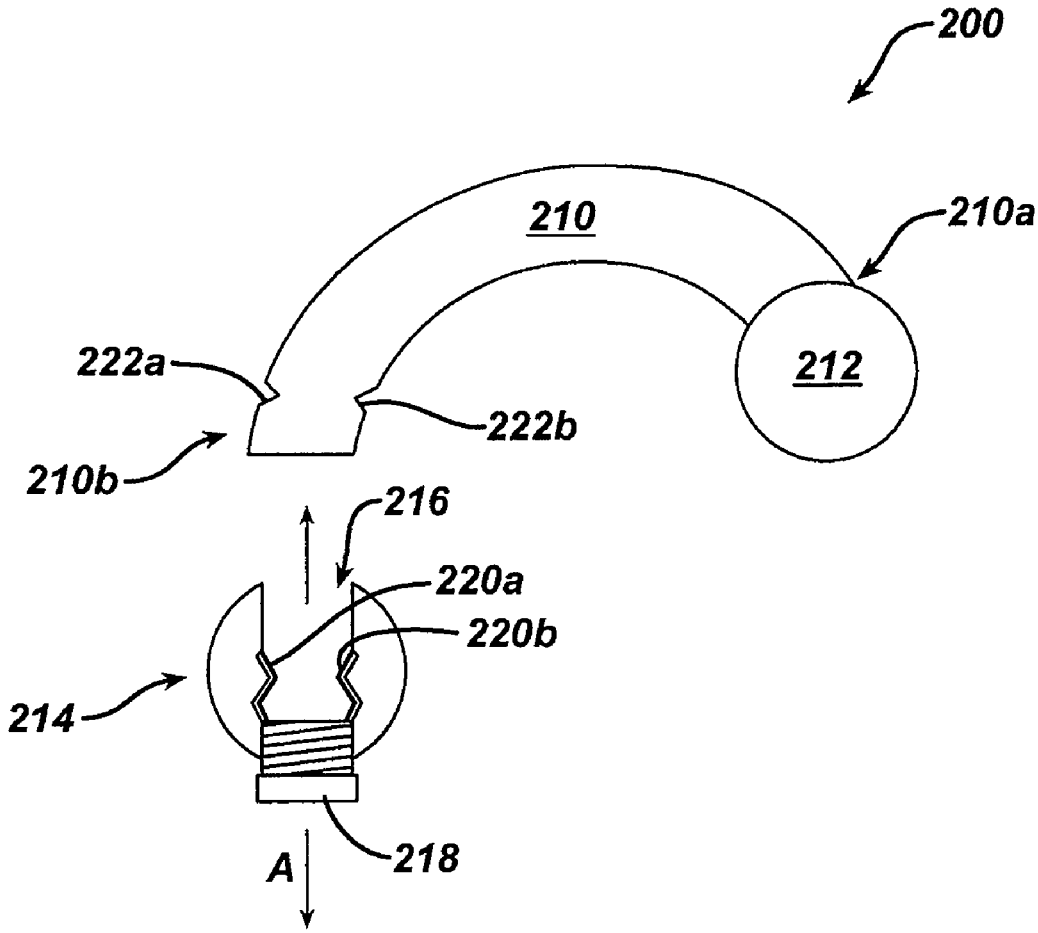
FIG. 3 is a side view of yet another embodiment of a barbell-type jewelry device in accordance with the present invention, shown in a disassembled configuration.
Figure 4:
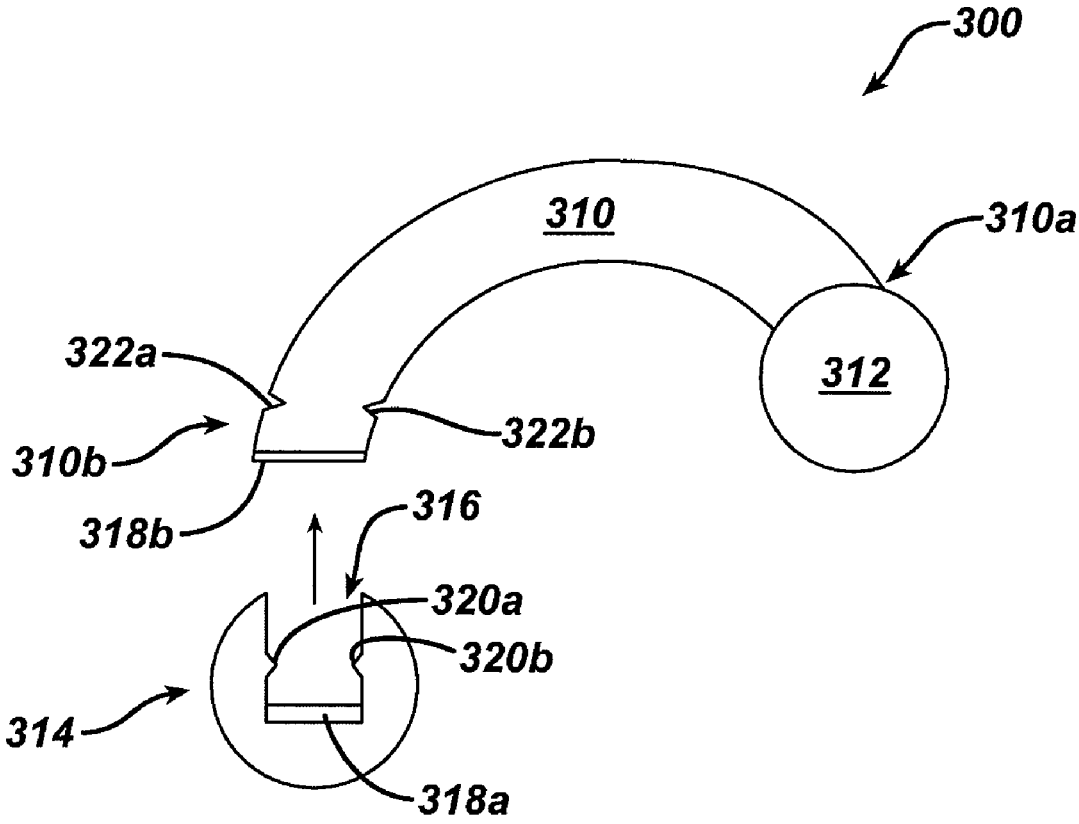
FIG. 4 is a side view of another embodiment of a barbell-type jewelry device in accordance with the present invention, shown in a disassembled configuration.

FIGS. 3-4 illustrate additional embodiments of barbell-type jewelry devices 200, 300 for use in a pierced naval orifice or other pierced body part. In general, the devices 200, 300 include a curved elongate member 210, 310 that is adapted to be disposed through a pierced naval orifice or other pierced body part, and that includes opposed first and second ends 210*a*, 210*b*, 310*a*, 310*b*. A person skilled in the art will appreciate that, while curved elongate members 210, 310 are shown, the elongate members 210, 310 can be straight or they can have a variety of other shapes and sizes for use at a variety of other locations on the body. As is further shown, the devices 200, 300 also include a first body 212, 312 that is preferably fixedly attached to the first end 210*a*, 310*a* of each elongate member 210, 310. Each body 212, 312 can have virtually any size and shape, and they can include other elements coupled thereto, such as decorate features. By way of non-limiting example, FIGS. 3-4 illustrate substantially spherical bodies 212, 312. Each body 212, 312 also preferably has a size that is adapted to prevent passage thereof through a pierced naval orifice or other pierced body part. In other words, each body 212, 312 has a diameter that is greater than a diameter of the elongate member 210, 310. Each device 200, 300 also includes a second body 214, 314 that is adapted to removably mate to the second end 212*b*, 312*b* of each elongate member 210, 320. The second bodies 214, 314 can also vary in shape and size, but preferably the second bodies 214, 314 each have a size that is adapted to prevent passage thereof through a pierced naval orifice or other pierced body part. In the illustrated embodiments, each body 214, 314 has a substantially spherical shape, and each body 214, 314 has a diameter that is greater than a diameter of the elongate member 210, 310. The second body 214, 314 of each device 200, 300 also preferably includes a cavity 216, 316 formed therein for receiving the second end 210*b*, 310*b* of the elongate member 210, 310 of each device 200, 300.

Various techniques can be used to removably mate the second body 214, 314 to the elongate member 210, 310 of each device 200, 300. In one exemplary embodiment, shown in FIG. 3, the body 214 can include a clamping mechanism formed within the cavity 216 and effective to clamp or engage the second end 210*b* of the elongate member 210, and optionally an actuating mechanism coupled to the clamping mechanism and effective to release the clamping mechanism upon actuation thereof. While virtually any clamping mechanism and/or actuating mechanism can be used, FIG. 3 illustrates opposed clip members 220*a*, 220*b* disposed within the cavity 216. The clip members 220*a*, 220*b* are preferably biased to an original position, shown in FIG. 3, in which the clip members 220*a*, 220*b* protrude into the cavity 216. In this position, the clip members 220*a*, 220*b* are effective to extend into grooves or detents 222*a*, 222*b* formed in the elongate member 210 adjacent the second end 210*b*. The clip members 220*a*, 220*b* are also movable to an extended position, in which the clip members 220*a*, 220*b* are substantially straightened such that the elongate member 210 can be released from engagement by the second body 214. By way of non-limiting example, a spring-type actuation mechanism 218, as shown, can be used to overcome the biasing force and straighten the clip members 220*a*, 220*b*. In particular, when the actuation mechanism 218 is pulled in a direction indicated by arrow A, the clip members 220*a*, 220*b* are pulled into a substantially straight configuration, thereby releasing the elongate member 210. A person skilled in the art will appreciate that a variety of other techniques can be used to provide for a removable connection between the elongate member 210 and the second body 214.

FIG. 4 illustrates yet another embodiment of an engagement mechanism for mating the second body 314 to the elongate member 310. In this embodiment, a magnet 318*a* is formed within the cavity 316 on the second body 314 for magnetically engaging the elongate member 310. The elongate member 310 can also optionally include a magnet 318*b* formed on the end 310*b* thereof, or alternatively the elongate member 310 can be formed from a material that allows the elongate member 310 to be engaged by the magnet 318. The device 300 can also optionally include one or more ridges or protrusions 320*a*, 320*b* that are effective to extend into and engage one or more grooves or detents 322*a*, 322*b* formed on the elongate member 310, as shown. The protrusions 320*a*, 320*b* and detents 322*a*, 322*b* facilitate a secure connection between the second body 314 and the elongate body 310 when the device is in use.

One of ordinary skill in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A body jewelry device for wearing in a pierced body part, comprising:

an elongate member adapted to be disposed through a pierced body part and having opposed first and second ends, the second end of the elongate member including a notch formed on an outer surface thereof;

a first body fixedly attached to the first end of the elongate member and having a size adapted to prevent passage thereof through a pierced body part; and a second body having a size adapted to prevent passage thereof through a pierced body part and having a cavity formed therein and adapted to removably receive the second end of the elongate member, a clamping mechanism formed within the cavity and effective to clamp the second end of the elongate member, the clamping mechanism including opposed clip members that extend radially inward to engage the notch formed on the outer surface of the second end of the elongate member, wherein the opposed clip members are movable between a first position in which the opposed clip members are bent to protrude into the cavity and engage the second end of the elongate member, and a second position in which the opposed clip members are substantially straightened to release the second end of the elongate member, and an actuating mechanism coupled to the clamping mechanism and effective to release the clamping mechanism upon actuation thereof, thereby releasing the second end of the elongate member from the second body.

2. The body jewelry device of claim 1, wherein the first and second bodies are substantially spherical.

3. The body jewelry device of claim 1, wherein the opposed clip members are biased to the first position.

4. The body jewelry device of claim 1, wherein the actuating mechanism is configured to be pulled away from the second body to move the opposed clip members from the first position to the second position.

5. A body jewelry device for wearing in a pierced body part, comprising:

a curved elongate member configured to be disposed through a pierced body part, the curved elongate member including opposed first and second ends, the second end having at least one detent formed therein;

a first body rigidly attached to the first end of the curved elongate member, the first body having a maximum diameter that is greater than a maximum diameter of the curved elongate member to prevent passage thereof through a pierced body part containing the curved elongate member;

a second body having a maximum diameter that is greater than the maximum diameter of the curved elongate member, the second body having a cavity formed therein that removably receives the second end of the curved elongate member, the cavity having a clamping mechanism formed on an inner surface of the cavity and extending radially inward to engage the at least one detent formed in the second end of the curved elongate member, wherein the clamping mechanism is movable between a first position in which the clamping mechanism engages the at least one detent formed in the second end of the curved elongate member, and a second position in which the clamping mechanism is substantially straightened to release the second end of the curved elongate member.

6. The body jewelry device of claim 5, wherein the clamping mechanism comprises opposed protrusions and the at least one detent comprises opposed detents that receive the opposed protrusions.

7. The body jewelry device of claim 5, wherein the clamping mechanism is biased to the first position.

8. The body jewelry device of claim 5, further comprising an actuation mechanism coupled to the clamping mechanism and configured to move the clamping mechanism between the first and second positions.

9. The body jewelry device of claim 8, wherein the actuation mechanism is slidably disposed within the cavity.

10. The body jewelry device of claim 8, wherein the clamping mechanism is bent to protrude into the cavity and engage the second end of the elongate member in the first position and substantially straightened to release the second end of the elongate member in the second position.

11. A body jewelry device for wearing in a pierced body part, comprising:

a curved elongate member configured to be disposed through a pierced body part, the curved elongate member including opposed first and second ends, the second end having at least one detent formed therein;

a first body rigidly attached to the first end of the curved elongate member, the first body having a maximum diameter that is greater than a maximum diameter of the curved elongate member to prevent passage thereof through a pierced body part containing the curved elongate member;

a second body having a maximum diameter that is greater than the maximum diameter of the curved elongate member, the second body having a cavity formed therein that removably receives the second end of the curved elongate member, the cavity having a clamping mechanism formed therein that engages the at least one detent formed in the second end of the curved elongate member; and a magnet disposed within the cavity in the second body and configured to magnetically engage a magnetic material on the second end of the curved elongate member.

* * * * *